United States Patent [19]

Hull

[11] Patent Number: 4,687,452

[45] Date of Patent: Aug. 18, 1987

[54] GAS-INFLATABLE, FLOATING, PORTABLE SEAT

[76] Inventor: Diane H. Hull, 1491 Ashland, #25 E, DesPlaines, Ill. 60016

[21] Appl. No.: 888,584

[22] Filed: Jul. 21, 1986

Related U.S. Application Data

[63] Continuation-in-part of Ser. No. 752,610, Jul. 8, 1985, Pat. No. 4,601,667.

[51] Int. Cl.[4] ..... B63C 35/74

[52] U.S. Cl. ..... 441/131; 114/345; 297/250

[58] Field of Search ..... 441/129–132; 114/351, 345, 346; 297/250, 252, DIG. 3, DIG. 6

[56] References Cited

U.S. PATENT DOCUMENTS

| | | | |
|---|---|---|---|
| 549,923 | 11/1895 | Layman | 114/351 |
| 3,620,570 | 11/1971 | Wilson | 297/448 |
| 3,712,674 | 1/1973 | Ando | 297/DIG. 3 |
| 3,740,095 | 6/1973 | Nail | 441/130 X |

FOREIGN PATENT DOCUMENTS

| | | | |
|---|---|---|---|
| 576709 | 4/1946 | United Kingdom | 441/131 |

*Primary Examiner*—Joseph F. Peters, Jr.
*Assistant Examiner*—Paul E. Salmon
*Attorney, Agent, or Firm*—Mason, Kolehmainen, Rathburn & Wyss

[57] ABSTRACT

A gas-inflatable, floating, portable, seat is especially adapted for supporting a child or other person in sitting position and is designed to be used in a boat or other vehicle or independently float on the water. The seat includes a first, generally annular-shaped, lower, inflatable float chamber fabricated from flexible sheet material adapted to provide needed buoyancy when placed in the water. A second, generally annular-shaped, upper, inflatable float chamber is secured on top of the first chamber and is formed with an open segment on a backside thereof to accommodate an upright seat back and the second chamber provides armrests on opposite sides of the seat back. A separately inflatable, seat cushion is detachably mounted on the lower float chamber in the open segment of the second float chamber. The seat includes a separately inflatable generally upstanding seat back projecting upwardly of the armrests and joined at the lower end to a portion of the lower float chamber between the ends of the upper float chamber. A bottom wall is provided to close off the space adjacent the lower level of the first float chamber and a second wall is provided to close off the space at an upper level of the lower float chamber to provide a ballast chamber to hold water as desired for maintaining the seat back in an upstanding position when the seat is floating on the water.

10 Claims, 6 Drawing Figures

GAS-INFLATABLE, FLOATING, PORTABLE SEAT

RELATED APPLICATION

This application is a continuation-in-part of my copending U.S. patent application Ser. No. 752,610, filed July 8, 1985, now U.S. Pat. No. 4,601,667, issued July 22, 1986, for GAS INFLATABLE, FLOATABLE, PORTABLE SEAT.

BACKGROUND OF THE INVENTION

1. Field of the Invention

The present invention relates to a new and improved gas-inflatable and floatable, portable seat and more particularly, a seat especially adapted for children and the like to support them in a sitting position while the seat is carried in a boat or other vehicle or when floating independently on the water. The portable seat includes a separately inflatable seat cushion which is detachably mounted on a lower annular float chamber and a separately inflatable seat back is attached to the lower float chamber to project upwardly in an upright position adapted to support a person sitting on the inflatable seat while floating in the water.

2. Description of the Prior Art

Canadian Patent No. 1,078,724 issued June 3, 1980 discloses a child's inflatable safety car seat, U.S. Pat. No. 3,712,674 issued Jan. 23, 1973, to Ando discloses an inflatable chair adapted to adhere to a floor by a suction principle, and U.S. Pat. No. 3,620,570 issued Nov. 16, 1971, to Wilson relates to a buoyant structure adapted to be supported on a solid supporting surface and to float on the water with an occupant therein.

OBJECTS OF THE PRESENT INVENTION

It is an object of the present ivention to provide a new and improved, gas-inflatable, portable seat which is adapted for supporting a person in sitting position while floating on the water.

More particularly, it is an important object of the present invnetion to provide a new and improved gas-inflatable, portable seat of the character described having a separately inflatable, seat cushion detachably mounted on a flotation support.

It is an object of the present invention to provide a gas-inflatable, floating, portable seat especially adapted for children and/or small persons to provide safety and fun on the water.

Another object of the present invention is to provide a new and improved, portable seat of the character described which is relatively small and compact when in an uninflated condition and which can be easily and rapidly inflated ready for use in a short time when needed.

Still another object of the present invention is to provide an inflatable seat of the character described which employs a plurality of independent, inflatable float chambers, each having its own inflatable valve for admitting air during inflation and discharging air for deflation.

Still another object of the present invention is to provide a new and improved, portable, inflatable seat of the character described which includes a safety belt for securing a child or other person in seated position.

Yet another object of the present invention is to provide a new and improved inflatable, portable, floating seat which employs a plurality of handles affording a person a means for convenient gripping and providing means for towing the seat on the water or for securing the same in a particular position.

Yet another object of the present invention is to provide a new and improved portable, air-inflatable seat which is pleasant in appearance, relatively low in cost, easy to inflate and deflate and yet still provides a safe and protective support for a small child and the like, while floating on the water.

Still another object of the present invention is to provide a new and improved gas-inflatable, portable, floating seat which includes a water ballast chamber for maintaining the seat with a seat back in a generally upright position and means for returning the seat back to the upright position after tipping or the like occurs.

BRIEF SUMMARY OF THE INVENTION

The foregoing and other objects and advantages of the present invention are accomplished in a new and improved, gas-inflatable, portable, floating seat, especially designed for supporting small children and the like in a sitting position while floating independently on the water. The seat includes a first, generally annular-shaped, lower, inflatable float chamber to provide the needed buoyancy when the seat is placed in the water and a second, generally annular "C"-shaped, upper inflatable float chamber is attached on top of the first float chamber and is provided with an open segment on the back side. An upright, independently inflatable seat back is attached to the lower float chamber in the open segment of the upper float chamber which forms armrests for the seat on opposite sides of the back. A separately inflatable, seat cushion is detachedly mounted on the lower float chamber and extends inwardly of the back and armrests from the open segment of the upper float chamber. Detachable fasteners are provided for securing the seat cushion to the float chamber and the seat cushion can be used separately while inflated and detached from the float chamber. A water ballast chamber including upper and lower walls is provided to close the lower end of the lower float chamber and a controlled amount of water may be introduced into the chamber to provide ballast for maintaining the back of the seat in a generally upright position.

BRIEF DESCRIPTION OF THE DRAWINGS

For a better understanding of the present invention, reference should be had to the following detailed description taken in conjunction with the drawings, in which.

DETAILED DESCRIPTION OF THE PREFERRED EMBODIMENT

Figure 1:
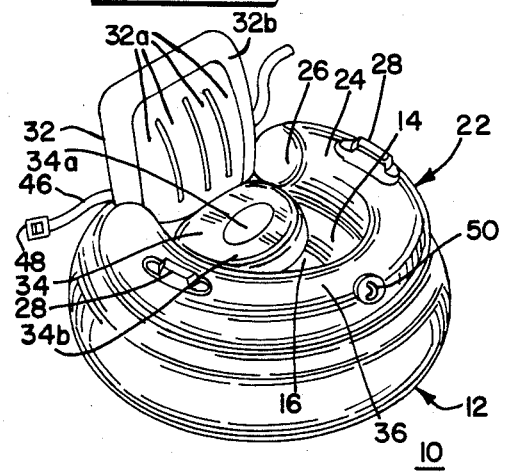
FIG. 1 is a front perspective view of a new and improved, gas-inflatable, portable, floating seat constructed in accordance with features of the present invention and illustrated in an inflated condition.

Referring now more particularly to the drawings, in FIG. 1 is illustrated a new and improved gas or air inflatable, portable seat which is adapted for supporting a person or child in a sitting position when inflated as best illustrated in FIGS. 1, 2, 3 and 4. The seat is referred to generally by the reference numeral 10 and is constructed of thin, flexible, gas impervious sheet material such as polyvinyl chloride film, commonly known as PVC. Other types of thin, flexible, waterproof material may also be utilized. PVC film in a thickness range of 2 through 10 mils is a desirable material because of its relatively low cost, easy fabrication, pleasant appearance and because the material is flexible througout a wide operating temperature range. Moreover, with the portable seat 10 is constructed of PVC film, the seat can be deflated and flattened out to occupy a very small volume space so that the seat may be packed away for easy storage.

In accordance with the present invention, the portable seat 10 includes a first, lower, gas-inflatable float chamber 12 of generally annular or doughnut shape forming a compartment 14 providing space for a child or other person in an upright or a sitting position on the seat. At the lower end, the compartment 14 is normally closed against the entry of water from below by a flexible bottom wall structure 16 comprising upper and lower, spaced apart bottom walls 16*a* and 16*b* of generally circular shape, which walls are secured around the outer perimeters with a watertight seam to the inner surface of the lower float chamber 12.

The upper and lower bottom walls 16*a* and 16*b* define a ballast space 18 therebetween which can be completely or partially filled with water through a control valve 19. When water is contained in the chamber 18, the water provides weight or ballast for submergence of the lower wall 16*b* slightly below the level of the water in which the seat is placed. This ballast weight is effective to maintain the seat in an upright position as illustrated best in FIG. 3 while floating on the water.

The ballast compartment 18 occupies a substantial percentage of the total base area of the seat and the ballast weight of water in the compartment is effective to perform a righting action on the seat while the seat is in an inflated condition floating on the water with a person therein. Because the ballast material is water, the compartment 18 can be drained after use so that only a minimum of storage space is required when the seat is deflated and folded up for storage.

Figure 5:
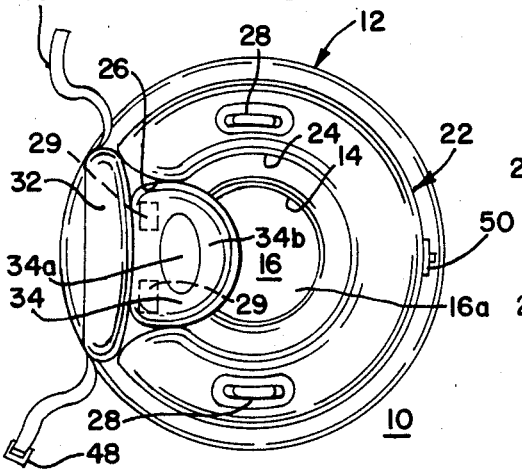
FIG. 5 is a top plan view of the floating, portable seat.
Figure 6:
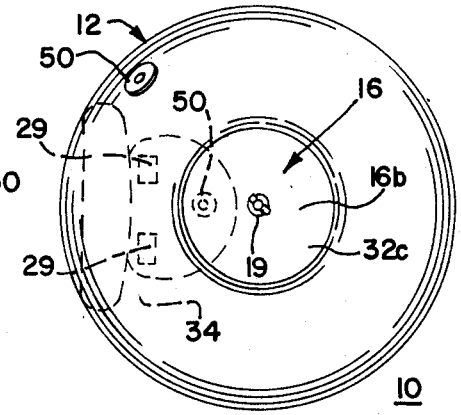
FIG. 6 is a bottom plan view of the floating, portable seat.

The seat 10 includes a second, upper, generally annular, inflatable float chamber 22 of a C-shape configuration which is separately inflatable and independent from the interior chamber of the lower float chamber 12. A lower portion of the outer surface of the upper chamber 22 is permanently attached to and sealed against an upper surface portion of the lower float chamber 12 by heat sealing or appropriate adhesive material. When the chambers are deflated, the sheet material may be pressed flat forming a generally circular outline as shown in FIGS. 5 and 6 and then folded up for storage. The interior space surrounded by the upper float chamber 22 provides a compartment 24 for a person occupying the portable seat 10 and both of the upper and lower float chambers provide physical protection for the person should the seat impact against another object. In addition, the upper float chamber 22 provides additional upward buoyant force for the seat 10 as may be needed for a person while sitting in the seat on the water.

In accordance with the invention, the upper, "C"-shaped float chamber 22 is formed with a circumferential cutout or open segment 26 adjacent a back side of the seat. The adjacent upper surfaces of the upper float chamber on opposite sides of the open segment provide convenient armrests. An occupant's forearms may rest on these armrests and conveniently grasp a pair of handles 28 formed of plastic material and positioned on opposite sides of the cutout or open segment 26. The handles 28 may be formed of molded plastic material with oval bases, heat sealed or otherwise attached to the upper surfaces of the upper float chamber 22.

In accordance with the present invention, the water buoyant, portable seat 10 is provided with a separately inflatable, detachable, seat cushion 34 which rests on the upper bottom wall 16*a* and is attached by a pair of "Velcro" type fasteners 29.

Detachment and reattachment of the seat cushion 34 to the float chamber 12 is simple and easy and involves only the use of the "Velcro" type fasteners 29.

The seat 10 also includes an independently inflatable upright seat back 32 mounted in the open segment 26 of the upper float chamber 22 and permanently attached to an upper surface the lower float chamber 12 by heat sealing or the like. When inflated and attached, the seat cushion 34 has an upper surface which extends at generally a right angle to the upright seat back 32 and the seat surface projects inwardly from the open segment 26 of the upper floatation chamber 22 into the compartment 24. The seat cushion 34 provides a supportive surface for a person while seated in the buoyant seat 10 with the person's back resting against the inside surface of the upright back 32.

Figure 3:
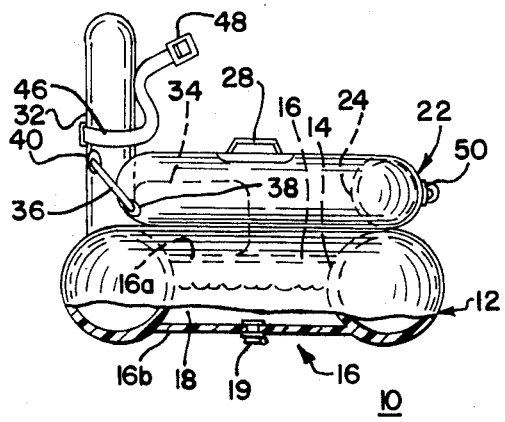
FIG. 3 is a side elevational view of the floating, portable seat.
Figure 4:
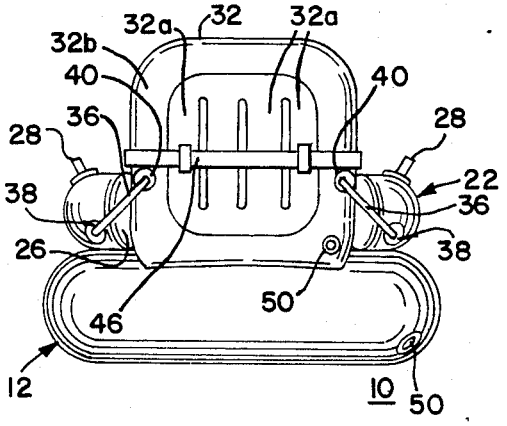
FIG. 4 is a rear elevational view of the floating, portable seat.

The separately inflatable seat back 32 is further secured to the upper float chamber 22 with a pair of connectors. In a prototype in accordance with the invention, a pair of resilient "bungee" cords 36 were utilized having hooks at opposite ends adapted to be detachably connected to anchoring devices 38 and 40 of resilient molded plastic material secured to the outisde surface of the upper float chamber 22 and the upstanding back, respectively, as shown in FIGS. 3 and 4. The cords 36 permit the inflated seat back to pivot or be tipped outwardly from an upright position but continuously bias the seat back to return to an upright position when the tipping or deflecting force is removed. Resilient plastic rings may also be connected between the devices 38 and 40 instead of bungee cords.

Figure 2:
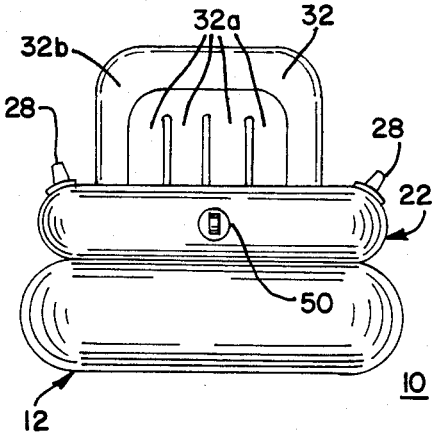
FIG. 2 is a front elevational view of the floating, portable seat.

As illustrated in FIGS. 1, 2 and 3, the back 32 is provided with a separate inflation valve 50 and includes a plurality of vertically extending, internal stiffening rib-like structures 32*a* and a peripheral, outside border element 32*b* around the rib structures to provide a degree of stiffness when inflated. The seat cushion 34 includes a depressed central segment 34*a* of oval shape surrounded by a peripheral border portion 34*b* to provide comfort and a degree of stiffness to the inflated seat surface. In order to firmly secure and hold a child or other person in the inflated seat 10, a safety belt 46 is provided. The belt is entrained around the back 32 and includes buckle 48 on one end.

In accordance with another important aspect of the portable seat 10, the gas or air-inflatable float chambers 12 and 22, the seat back 32 and the seat cushion 34 are independent from one another with respect to the interior volumes that are filled with gas or air. Each of the chambers is provided with a separate and independent, inflation valve 50 which is independently controllable to inflate or deflate its respective internal chamber. Should the lower float chamber 12 become punctured or spring a leak, the loss of inflation will not affect the amount of inflation in the seat back or seat cushion or the upper, inflation chamber 22 and these will still provide adequate floatation and protection for an occupant in the portable seat 10. Similarly, loss of inflation of the upper float chamber 22 or the seat cushion 34 will not affect the inflation of the lower chamber 12 or the seat back 34 as the case may be.

The portable, gas-inflatable seat 10 may be used in a variety of different environments as a floating device or a toy. The flotation chambers 12 and 22 and the independent detachable seat cushion 34 and seat back 32 provide physical protection for the occupant of the seat 10 against impact and also provide the necessary flotation or buoyancy.

Although the present invention has been described with reference to a single illustrated embodiment thereof, it should be understood that numerous other modifications and embodiments can be made by those skilled in the art that will fall within the spcmrit and scope of the principles of this invention.

What is claimed as new and is desired to be secured by Letters Patent is:

1. A gas-inflatable, floating, portable seat for supporting a person on the water, said seat comprising:

a first, generally annular-shaped, lower inflatable float chamber defining a compartment for said person and adapted to provide bouyancy when inflated and placed in water;

a water ballast compartment inside said lower float chamber;

a second, generally annular-shaped, upper inflatable float chamber mounted on top of said first float chamber formed with an open segment on a back side thereof and forming arm rests on opposite sides of said open segment;

a separately inflatable seat cushion adapted to be detachably mounted on said lower float chamber adjacent said open segment of said upper float chamber, said seat cushion suitable for use as a cushion while detached from said float chamber;

an upstanding inflatable seat back projecting upwardly of said first float chamber mounted in said open segment and attached to said first float chamber; and securement means for detachably securing said seat cushion in place on said lower float chamber adjacent said open segment of said upper float chamber.

2. The portable seat of claim 1 including seat belt means extendable from said seat back for securing said person on said seat.

3. The portable seat of claim 2 wherein said seat belt means has opposite end portions extending around said seat back from opposite sides.

4. The portable seat of claim 1 including hand grip means secured on the upper surface of said second float chamber for gripping by a person in said seat.

5. The portable seat of claim 1 including a bottom wall structure for said lower float chamber comprising a pair of spaced apart upper and lower flexible sheets attached to said first float chamber so as to form said ballast compartment between said sheets, and a water valve on said lower sheet for admitting water into and out of said compartment to serve as ballast.

6. The portable seat of claim 5 wherein said ballast compartment is adapted to hold enough water to submerge an underside of said first float chamber below an adjacent water level when said float chambers and seat back and cushion are inflated and said seat is floating in said water.

7. The portable seat of claim 1 wherein said securement means includes "Velcro" type fastening means for detachably securing said seat cushion to said lower float chamber.

8. The portable seat of claim 7 wherein said fastening means comprises seat belt means for securing a person on said seat.

9. The portable seat of claim 1 wherein said first and second float chambers and said seat back are secured to one another at confronting external surface areas, and wherein each of said float chambers and said seat back includes a separate inflation valve for admitting and discharging gas from the interior thereof independent of the others.

10. The portable seat of claim 1 including resilient means for interconnecting said seat back and said upper float chamber whereby said seat back is biased toward an upright position but is pivotable away from said upright position.

* * * * *